United States Patent [19]

Mezger et al.

[11] Patent Number: 4,864,988

[45] Date of Patent: Sep. 12, 1989

[54] LUBRICATING ARRANGEMENT FOR A RECIPROCATING PISTON INTERNAL COMBUSTION ENGINE

[75] Inventors: Hans Mezger, Freiberg; Peter Schmid, Pleidelsheim; Dieter Nowak, Weilheim/Teck, all of Fed. Rep. of Germany

[73] Assignee: Dr. Ing. h.c.F. Porsche AG, Stuttgart, Fed. Rep. of Germany

[21] Appl. No.: 239,394

[22] Filed: Sep. 1, 1988

[30] Foreign Application Priority Data

Sep. 4, 1987 [DE] Fed. Rep. of Germany ..... 3729603

[51] Int. Cl.[4] ..... F02B 77/00

[52] U.S. Cl. ..... 123/198 C; 123/196 R

[58] Field of Search ..... 123/196 R, 198 C; 417/360, DIG. 1; 418/206; 184/26

[56] References Cited

U.S. PATENT DOCUMENTS 4,436,067 3/1984 Fritzenwenger ..... 123/198 C 4,449,491 5/1984 Tsuchiyama et al. ..... 123/90.34

*Primary Examiner*—E. Rollins Cross

*Attorney, Agent, or Firm*—Barnes & Thornburg

[57] ABSTRACT

A lubricating arrangement attached end face at the engine housing of a reciprocating piston engine is surrounded by an oil pump housing which is composed of two housing parts cast of magnesium. The oil pumps are preassemblable in the oil pump housing. The couplings of the oil pumps and the lubricating connections are so constructed that the oil pump housing is easily assemblable at the engine housing as a structural unit.

23 Claims, 3 Drawing Sheets

LUBRICATING ARRANGEMENT FOR A RECIPROCATING PISTON INTERNAL COMBUSTION ENGINE

BACKGROUND AND SUMMARY OF THE INVENTION

The present invention relates to a lubricating system for a multi-cylinder reciprocating piston engine in which at least one oil pump which is driven by the crankshaft thereof, is accommodated in an end face oil pump housing threadably connected to the engine housing and which delivers lubricating oil from an oil reservoir tank by way of a filter and distribution channels to the bearing places of the crankshaft, of the cam shaft and to other lubricating places.

In such a lubricating system as disclosed in the DE-PS No. 32 03 312, a housing for a lubricating oil pump is formed in an end cover that is flangedly connected to the engine housing. The lubricating oil pump and the gear driving the same are disposed coaxially to the crankshaft. The lubricating oil pump sucks the oil out of a reservoir tank and feeds the same by way of distribution channels and an oil filter that is attached to the outer side surface of the end cover, to the lubricating places of the engine. This lubricating system is quite well suited for a low-speed engine. However, in a high-speed engine considerable noises would emanate from the oil pump housing formed by the bending-soft end cover.

It is therefore the object of the present invention to so construct a lubricating system for a reciprocating piston engine that it enables an adequate lubrication also at highest engine rotational speed without excessive noise radiation. The oil pump housing is thereby to be compact, form-stable and to be assemblable at the engine housing in a simple manner, and the lubricating system is to be utilizable at the same time for an oil sump lubrication and for a dry sump lubrication.

The underlying problems are solved according to the present invention in that the oil pump housing is constructed as a preassemblable structural unit closed in itself and consisting of two cast housing parts threadably secured at their separating surface and centered with respect to one another. If the oil pump is closely surrounded by a housing which is composed of two mutually centered and mutually threadably connected housing parts, a fitting-accurate and stable bearing support can be achieved for the pump wheel so that the noise formation is minimal and a noise radiation from a large-area end cover is avoided. A simple and reliable assembly is made possible in that the oil pump housing is constructed together with the oil pump and its bearing support as preassemblable structural unit. According to another feature of the present invention, after the attachment of this structural unit at the engine housing, the inner part of the oil pump housing is centered in the engine housing and is sealed radially, while the outer housing abuts end face sealed at the engine housing and is threadably connected together with the same.

Such a lubricating arrangement is suited both for an oil sump lubrication in which it sucks off oil out of the crankcase as also for a dry sump lubrication in which a separate lubricating oil reservoir tank is provided. In order to achieve a further noise reduction and an improvement of the oil delivery, provision is made according to another feature of the present invention to utilize in lieu of one large oil pump which acts at the same time as suction and pressure pump, two smaller oil pumps, of which one operates as suction pump and the other as pressure pump. According to still a further object of the present invention, a cylindrical oil filter is located centrally between the horizontally installed pressure pump and the suction pump disposed parallel thereto with the oil further disposed transversely with respect to the two pumps, whose filter cartridge can be disassembled in the downward direction. The housings of the oil pumps and of the oil filter are fitted-in into the outer contour of the oil pump housing cast of magnesium whereby the outer diameter of the filter housing is approximately equal to the thickness of the oil pump housing and the length of the filter housing is approximately equal to the height of the oil pump housing.

According to still another object of the present invention, a regulator housing is cast-on to the top side of the oil pump housing approximately aligned to the filter housing, which contains a pressure regulator adapted to be removed in the upward direction. The combination of these different aggregates in a single cast part makes it possible to cast all connecting channels for the lubricating oil into the same so that pipes or hoses can be dispensed with.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1:
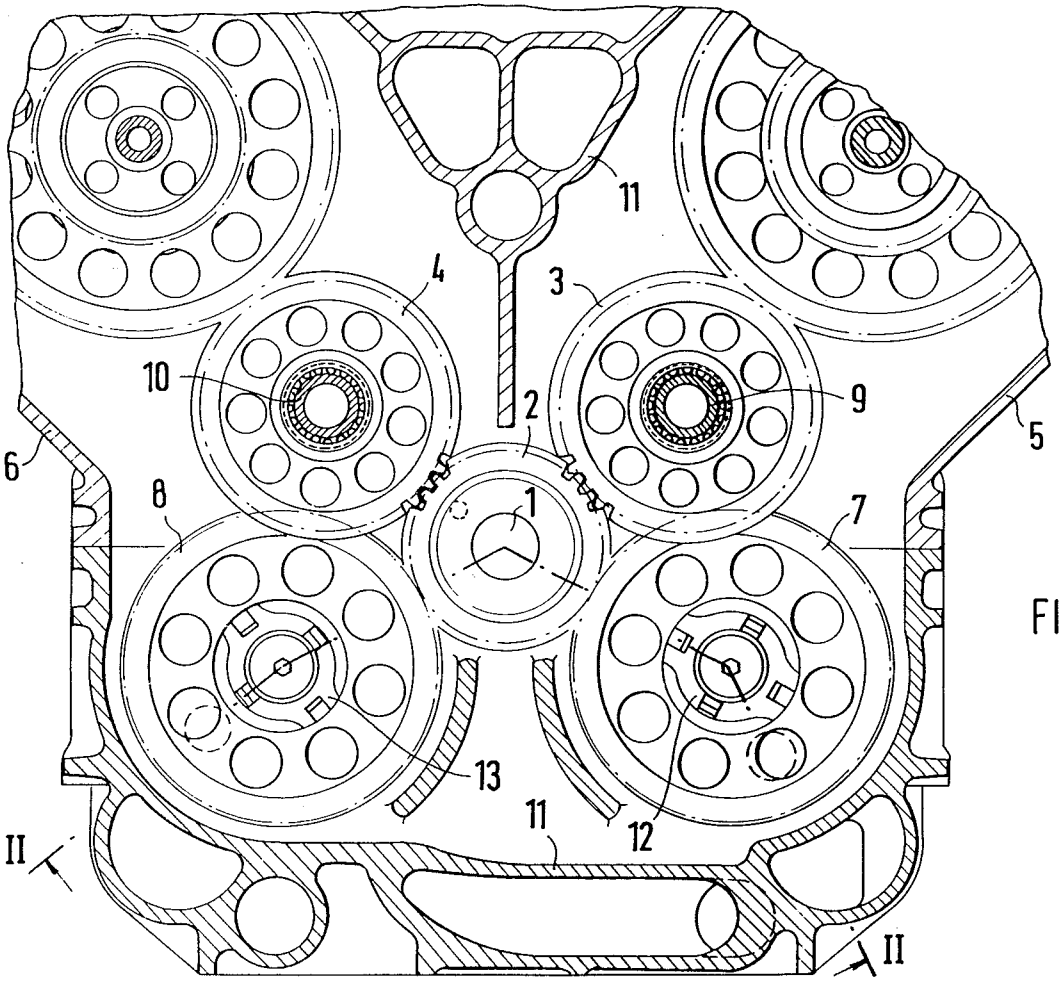
FIG. 1 is a cross-sectional view through the lower part of a multi-cylinder V-engine with a lubricating arrangement in accordance with the present invention.

Referring now to the drawing wherein like reference numerals are used throughout the various views to designate like parts, a crankshaft 1 supported centrally in a V-engine drives with its crankshaft gear 2 in the upward direction the gears 3 and 4, by means of which the control transmissions for the cam shafts of the two cylinder rows 5 and 6 are driven (FIG. 1). In the downward direction, the crankshaft gear 2 meshes toward the right with a gear 7 and toward the left with a gear 8, by means of which oil pumps are driven. The gears 7 and 8 are supported by means of needle bearings on bearing bolts 9 and 10 (FIG. 2) which are secured in the engine housing 11. End face the gears 7 and 8 carry coupling pieces 12 and 13. The latter cooperate form-lockingly with the coupling counterpieces 14 and 15 and together with the same form plug-in couplings generally designated by reference numerals 16 and 17 which can compensate an axial offset similar to Oldham couplings.

The coupling piece 14 is attached end face at a shaft 18, by means of which a pressure pump 19 is driven and which is supported in two slide bearings of an oil pump housing generally designated by reference numeral 20. The pressure pump 19 by means of which lubricating oil is fed to the bearing places of the V-engine, is a gear pump consisting of two mutually meshing gears 21 and 22. The gear 21 is non-rotatable with the shaft 18 and the gear 22 is non-rotatable with the parallel shaft 23 supported also in slide bearings of the oil pump housing 20. A further gear pump is driven and supported by means of the same shafts 18 and 23 which serves as suction pump 24 for sucking lubricating oil out of the turbochargers 25 (FIG. 3).

To the left of the crankshaft 1, two further suction pumps 26 and 27 for sucking lubricating oil out of the engine housing 1 are arranged in the oil pump housing 20 coaxially to one another. They are also gear pumps consisting of two mutually meshing gears which are non-rotatable on the hollow shafts 28 and 29. The hollow shaft 28 is driven by way of the coupling piece 15 attached at the same end face. Both hollow shafts 28 and 29 are supported on both sides in slide bearings of the oil pump housing 20.

Figure 2:
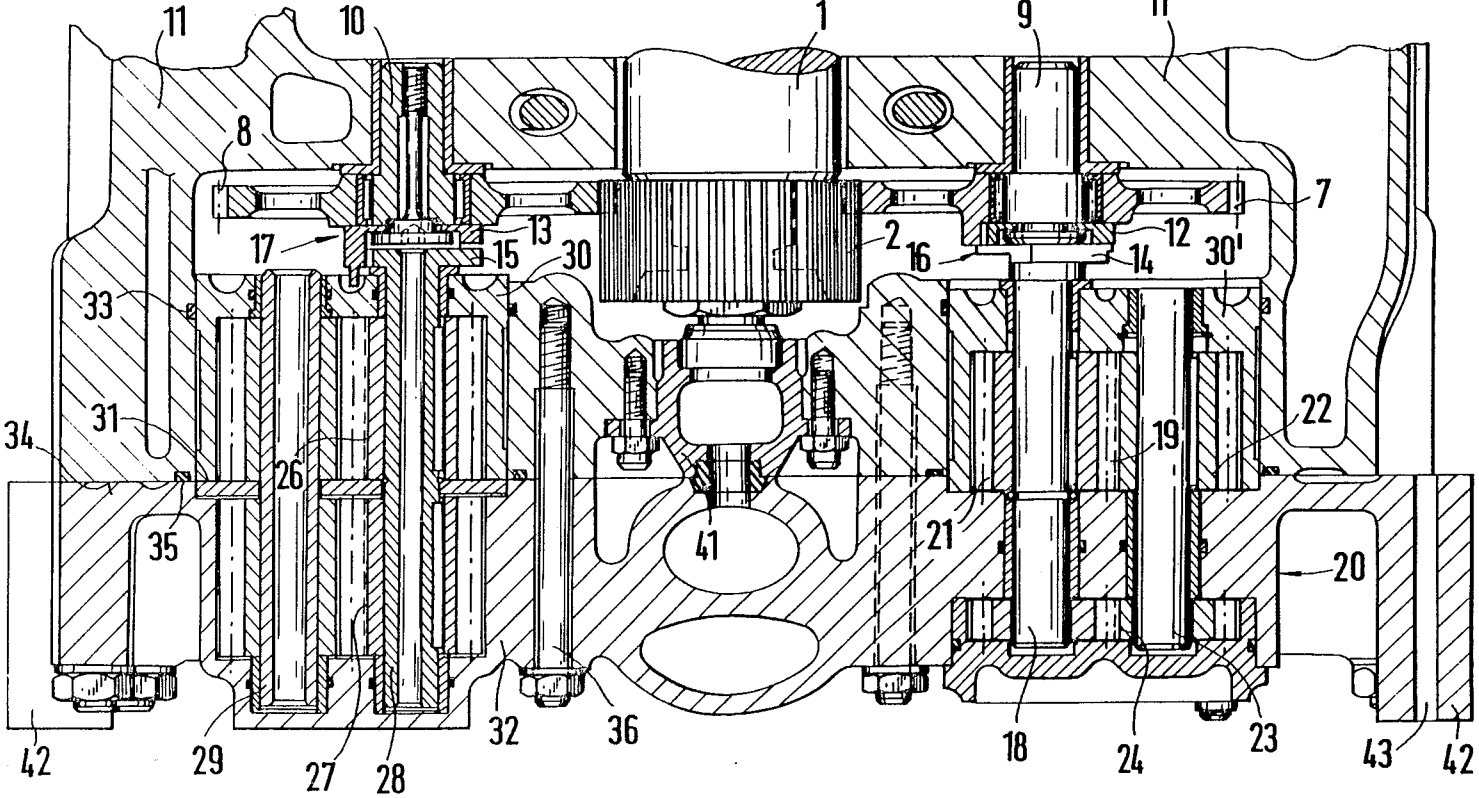
FIG. 2 is a cross-sectional view taken along line II-0-II of FIG. 1, on an enlarged scale.

The oil pump housing 20 is assembled of three housing Parts which are cast of magnesium. The oil pump housing 20 consists of an inner part 30, of an inner part 30' and of an outer part 32 centered with respect to the same and threadably connected with the same along a separating plane 31 (FIG. 2). The inner parts 30 and 30' are centered within the area of the pressure pump 19 and of the two suction pumps 26 and 27 in bores of the engine housing 11 and are sealed off by radial seals 33. The outer part 32 abuts at the end face 34 of the engine housing 11, is sealed off with respect thereto by means of axial seals 35 and is secured at the engine housing 11 by bolts 36.

Figure 3:
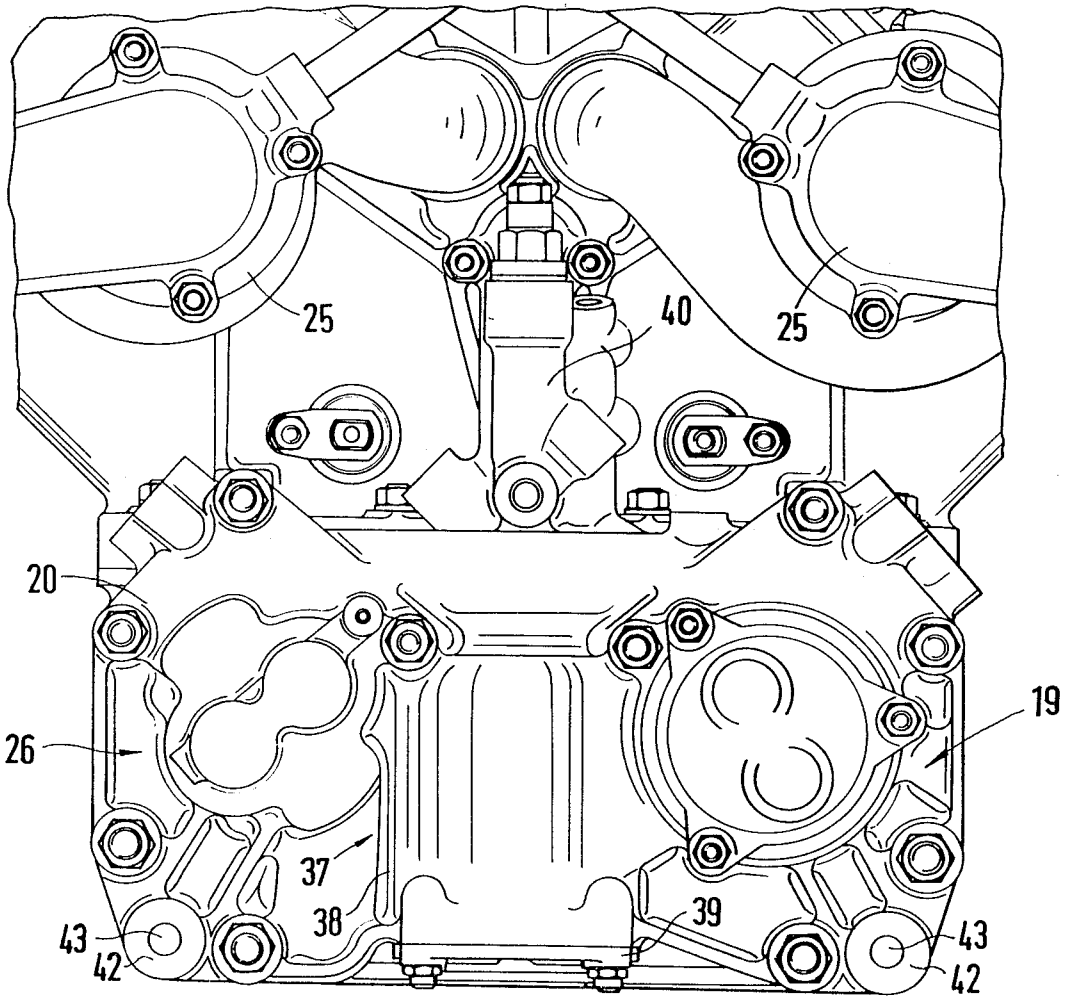
FIG. 3 is a front elevational view of FIG. 1.

Approximately centrally between the two suction pumps 26 and 27 and the pressure pump 19 an oil filter 37 is arranged transversely to the same (FIG. 3). Its cylindrical filter housing 38 is integrated into the outer contour of the oil pump housing 20 in that its outer diameter is equal to the thickness of the oil pump housing 20 and its length is equal to the height of the oil pump housing 20. After loosening the filter cover 39, the filter cartridge can be pulled out in the downward direction.

A regulator housing 40 is cast-on at the top side of the oil pump housing 20 which contains a pressure regulator for the lubricating oil and an oil channel to the central feed of the lubricating oil in a center bore of the crankshaft 1. An elastic bushing serves for the connection of the center bore with the oil channel which is centered in an oil mounting cap 41 of the crankshaft 1 and in the oil channel of the regulator housing 40.

Bearing eyes 42 are cast-on at the lower corner points on the outer part 32 of the oil pump housing 20, whose bores 43 are disposed parallel and equidistant to the crankshaft 1. The bearing eyes 42 and the walls of the oil pump housing 20 are constructed so bending- and torsion-resistant that they can readily absorb the weight of the engine and the dynamic mass forces caused by the same.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A lubricating arrangement for a multi-cylinder reciprocating piston engine in which at least one oil pump means is driven by th engine crankshaft, comprising oil pump housing means which is threadably attached end face at the engine housing to accommodate the oil pump means, the oil pump means being operable to supply lubricating oil from an oil reservoir by way of a filter means and distribution channels to bearing places of the engine, and the oil pump housing means being constructed as enclosed preassemblable structural unit of two cast housing parts threadably secured together and mutually centered at their separating surface.

2. A lubricating arrangement according to claim 1, wherein the lubricating places include lubricating places of the crankshaft, of the cam shaft and other lubricating places.

3. A lubricating arrangement according to claim 1, wherein the oil pump housing means is assembled of an inner part centered in the engine housing and radially sealed and of an outer part sealed off and threadably secured at the engine housing end face.

4. A lubricating arrangement according to claim 3, wherein the oil pump housing means contains a pressure pump means located to one side of the crankshaft and at least one suction pump means parallel thereto and located to the other side of the crankshaft, the pressure pump means and the suction pump means being arranged below the substantially horizontally disposed crankshaft, substantially parallel thereto and approximately equidistant therefrom.

5. A lubricating arrangement according to claim 4, wherein the cylindrical oil filter means is arranged approximately centrally between the pressure pump means and the suction pump means and located transversely thereto whose filter cartridge is adapted to be pulled out downwardly in a substantially vertical direction.

6. A lubricating arrangement according to claim 5, wherein the housing means of the pressure pump means, of the suction pump means and of the oil filter means are fitted-in into the outer contour of the cast oil pump housing means.

7. A lubricating arrangement according to claim 6, further comprising a regulator housing means cast-on at the top side of the oil pump housing means which contains a pressure regulator adapted to be taken out in the upward direction and an oil channel leading to a central oil feed in the crankshaft.

8. A lubricating arrangement according to claim 7, wherein two suction pump means driven by a common hollow shaft are supported in the oil pump housing means coaxially to one another.

9. A lubricating arrangement according to claim 8, wherein the pressure pump means and the suction pump means are driven by the crankshaft by way of gears arranged coaxially to their shafts and supported in the engine housing.

10. A lubricating arrangement according to claim 9, wherein the hollow shaft of the suction pump means and the shaft of the pressure pump means are connectable with the gears by way of plug-in couplings.

11. A lubricating arrangement according to claim 8, wherein the suction pump means and the pressure pump means are constructed as gear pumps and their two mutually meshing gears are arranged at the separating plane from the inner part to the outer part of the oil pump housing means.

12. A lubricating arrangement according to claim 11, wherein the oil pump housing means is constructed as bending- and torsion-resistant bearer part for the reciprocating piston engine and wherein bearing eyes are cast-on at the oil pump housing means on both sides whose bores are located approximately parallel and equidistant to the crankshaft.

13. A lubricating arrangement according to claim 1, wherein the oil pump housing means contains a pressure pump means located to one side of the crankshaft and at least one suction pump means parallel thereto and located to the other side of the crankshaft, the pressure pump means and the suction pump means being arranged below the substantially horizontally disposed crankshaft, substantially parallel thereto and approximately equidistant therefrom.

14. A lubricating arrangement according to claim 13, wherein the cylindrical oil filter means is arranged approximately centrally between the pressure pump means and the suction pump means and located transversely thereto whose filter cartridge is adapted to be pulled out downwardly in a substantially vertical direction.

15. A lubricating arrangement according to claim 14, wherein the housing means of the pressure pump means, of the suction pump means and of the oil filter means are fitted-in into the outer contour of the cast oil pump housing means.

16. A lubricating arrangement according to claim 1, further comprising a regulator housing means cast-on at the top side of the oil pump housing means which contains a pressure regulator adapted to be taken out in the upward direction and an oil channel leading to a central oil feed in the crankshaft.

17. A lubricating arrangement according to claim 4, wherein two suction pump means driven by a common hollow shaft are supported in the oil pump housing means coaxially to one another.

18. A lubricating arrangement according to claim 17, wherein the pressure pump means and the suction pump means are driven by the crankshaft by way of gears arranged coaxially to their shafts and supported in the engine housing.

19. A lubricating arrangement according to claim 18, wherein the hollow shaft of the suction pump means and the shaft of the pressure pump means are connectable with the gears by way of plug-in couplings.

20. A lubricating arrangement according to claim 19, wherein the suction pump means and the pressure pump means are constructed as gear pumps and their two mutually meshing gears are arranged at the separating plane from the inner part to the outer part of the oil pump housing means.

21. A lubricating arrangement according to claim 13, wherein two suction pump means driven by a common hollow shaft are supported in the oil pump housing means coaxially to one another.

22. A lubricating arrangement according to claim 13, wherein the pressure pump means and the suction pump means are driven by the crankshaft by way of gears arranged coaxially to their shafts and supported in the engine housing.

23. A lubricating arrangement according to claim 4, wherein the suction pump means and the pressure pump means are constructed as gear pumps and their two mutually meshing gears are arranged at the separating plane from the inner part to the outer part of the oil pump housing means.

* * * * *